US009135898B1

(12) United States Patent
McVicker

(10) Patent No.: US 9,135,898 B1
(45) Date of Patent: Sep. 15, 2015

(54) FINGER PICK FOR STRINGED INSTRUMENT

(71) Applicant: Richard E. McVicker, Indianapolis, IN (US)

(72) Inventor: Richard E. McVicker, Indianapolis, IN (US)

( * ) Notice: Subject to any disclaimer, the term of this patent is extended or adjusted under 35 U.S.C. 154(b) by 0 days.

(21) Appl. No.: 14/497,047

(22) Filed: Sep. 25, 2014

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | | |
|---|---|---|---|---|---|
| 842,920 | A | * | 2/1907 | Thedorf | 84/322 |
| 1,787,136 | A | * | 12/1930 | Beauchamp | 84/322 |
| 3,699,838 | A | | 10/1972 | Montgomery | |
| 3,739,681 | A | * | 6/1973 | Dunlop | 84/322 |
| 4,625,616 | A | | 12/1986 | McVicker | |
| D356,593 | S | * | 3/1995 | Purcell | D17/20 |
| 5,864,075 | A | * | 1/1999 | Mapson | 84/322 |
| 5,981,857 | A | * | 11/1999 | Mapson | 84/322 |
| 7,375,268 | B1 | * | 5/2008 | Thornhill | 84/320 |
| 8,389,839 | B2 | * | 3/2013 | McVicker | 84/322 |
| 8,764,898 | B2 | * | 7/2014 | Hobbs et al. | 106/205.71 |

OTHER PUBLICATIONS

Acri Fingerpick—Large Steel, dated prior to Sep. 25, 2014, p. 1, Elderly Instruments, available at http://elderly.com/accessories/items/ACFP-Steel-L.htm.

Acri Fingerpick—Medium Brass, dated prior to Sep. 25, 2014, p. 1, Elderly Instruments, available at http://elderly.com/accessories/items/ACFP-BRASS-M.htm.

Butterfly Finger Picks, dated prior to Sep. 25, 2014, p. 1, Butterfly Finger Picks, available at http://www.butterflyfingerpicks.com.

Fingernail Pick for playing stringed instruments, dated prior to Sep. 25, 2014, pp. 1-2, aLaska Pik, available at http://www.alaskapik.com.

Fingerpicks, dated prior to Sep. 25, 2014, pp. 1-6, Elderly Instruments, available at http://elderly.com/accessories/cats/PKFG.htm.

* cited by examiner

*Primary Examiner* — Robert W Horn
(74) *Attorney, Agent, or Firm* — Brinks Gilson & Lione

(57) ABSTRACT

A finger pick for being retained on a user's finger and for aiding in the playing of a stringed musical instrument includes a base portion, sizing wings, a spoon portion, and an opening defined by the base portion and the sizing wings. The sizing wings are bent upward from the base portion to define an interior space into which a user's finger is received to attach the finger pick to the finger. The opening extends transversely across the base portion and upward into the sizing wings when the sizing wings are bent upward. When the finger pick is inserted on the finger of a user, the soft tissue of the finger will protrude outwardly from the sizing wings and also through the opening, providing for three points of contact to the retain the finger pick on the finger.

20 Claims, 3 Drawing Sheets

FINGER PICK FOR STRINGED INSTRUMENT

FIELD

This disclosure relates to musical instrument playing aids. More particularly, this disclosure relates to a finger pick for use with stringed instruments.

BACKGROUND

Musical instruments, in particular stringed musical instruments are well known in the art. Stringed instruments can include acoustic or electric guitars, banjos, violins or fiddles, bass guitars, as well as other common and less common stringed instruments.

The basic construction of a stringed instrument depends on the type of stringed instrument. However, in most cases, the instrument includes a main body portion and a neck portion extending upwardly from the main body portion. The strings are typically connected at one end to the main body portion and at their other end to the top of the neck portion. The strings have varying thicknesses such that when they are actuated by the musician, they will produce a different sound relative to the other strings, such that a musician can play a desired note by actuating a desired string. The tension in the strings is also typically adjustable, such that the strings can be tuned and re-turned over time.

In some cases, the instrument will include frets located on the neck of the instrument. The frets are located in specific positions that allow a musician to produce a different note on the same string during a performance. The musician can effectively shorten the length of a string by pressing down on the string near a desired fret such that the string vibrates at a different frequency relative to the vibration that would be produced if it was allowed to vibrate over its entire length. In some cases, the length of a string's vibration can be adjusted without the use of frets.

The manipulation and actuation of the strings on a stringed instrument is an important factor in producing the desired musical notes and at the desired rhythm. Accordingly, playing aids of various types have been produced to assist musicians in their ability to play the instrument as desired.

One manner of playing a stringed instrument without an aid involves the musician using multiple fingers to actuate the strings. However, this can lead to blistering or discomfort to the musician due to the repeated direct contact with the strings. Moreover, the volume produced by using fingers without an aid is lower than that produced with playing aids.

One type of aid includes the use of a traditional guitar pick. A guitar pick is in the form of a thin plate-like structure that is typically held between the thumb and forefinger of the musician, allowing the musician to actuate one or more strings of the instrument. This type of device is particularly beneficial for "strumming" the strings. However, the pick can easily be dropped from the fingers, forcing the musician to stop playing or revert to using his fingers, both of which can be undesirable. One solution to this problem is in the form of a tether that can be attached to one of the musician's fingers, such that the pick is easily retrieved if dropped, but it does not prevent dropping of the pick.

SUMMARY

A pick for playing stringed instruments is provided, the pick having a base portion defining a longitudinal length and a pair of sizing wings extending laterally outward from opposite sides of the base portion and being substantially arcuate to extend from the base portion in a curved manner. The base portion and the sizing wings define an interior space and a longitudinal axis extending from a distal end to a proximal end. The pick further includes a spoon portion extending proximally from the base portion. The pick also includes an opening defined by the base portion and the sizing wings that extends laterally across the base portion and into the sizing wings.

When the pick is attached to the end of a user's digit, the soft tissue of the digit around the base of the fingernail will ultimately extend outward in front of the sizing wings, and the soft tissue of the digit on the pad of the digit will protrude through the opening, thereby working to retain the pick on the digit.

The sizing wings are malleable to account for different sizes of the user's digit, but they do not need to clamp against the sides and top of the user's digit to keep the pick in place due to the protrusion of the soft tissue through the opening providing additional retention capability.

In another aspect, a pick for being retained on a user's digit includes a base portion, a spoon portion extending in a proximal direction from the base portion, and a pair of wings being arcuately formed and extending outwardly from the base portion and being disposed distally from the spoon portion. The pick further includes a stabilizer portion extending proximally from an end of at least one of the wings. The base portion, spoon portion, and wings combine to define an interior space having a longitudinal axis, and the stabilizer is disposed on the opposite side of the longitudinal axis from the base portion and the spoon portion.

The stabilizer is configured to be disposed on the outer surface of the user's fingernail when the pick is attached. The stabilizer works to counteract the recoil that occurs when the pick is used on an instrument.

In another aspect, a pick includes a base portion having proximal and distal ends and a pair of sizing wings extending outwardly from the base portion and curving away from the base portion. The sizing wings each having a proximally facing front edge. An opening is defined by the base portion and sizing wings. The opening extends through the base portion and sizing wings and defines a proximally facing rear edge. The proximally facing front edges of the sizing wings and the proximally facing rear edge of the opening combine to define three points of contact for contacting soft tissue of a user's digit when the pick is inserted over the end of the user's digit.

The pick therefore provides three points of contact to retain the pick on the user's digit, and uses the natural outward forces of the soft tissue to its advantage to keep the pick in place.

Additional benefits and advantages will become apparent to those skilled in the art from the subsequent description of the preferred embodiment and the appended claims, taken in conjunction with the accompanying drawings.

DETAILED DESCRIPTION OF THE PREFERRED EMBODIMENTS

Musicians have developed a technique of plucking the strings of a stringed instrument using the thumb and two fingers, known as three-finger style, in which it is desired for picks to be firmly and securely attached to each digit of the musician or user, independent of the other digits used in the playing style.

Accordingly, a finger pick 10 is provided in various embodiments illustrated in FIGS. 1-10. The finger pick 10 can be attached to the end of a user's finger independent of other digits on the user's hand to aid the user in playing a musical instrument, more particularly a stringed musical instrument.

Figure 1:
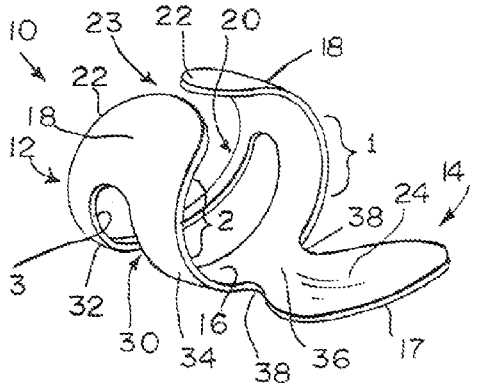
FIG. 1 is an isometric view of an embodiment of a finger pick.

With reference to FIG. 1, the finger pick 10 includes a proximal end 12 and a distal end 14 and defines a longitudinal axis A extending therebetween. The finger pick 10 further includes a base portion 16 disposed at the distal end 14 and a spoon portion 17 disposed at the proximal end 12.

The base portion 16 includes a pair of sizing wings 18 extending outwardly from the longitudinal axis A. The sizing wings 18 have a generally curved shape, curving upward from the base portion 16 to define an interior portion 20 within the base portion and the sizing wings 18.

The sizing wings 18 include outer edges 22 that have a generally curved and rounded shape in one approach. The outer edges 22, when the sizing wings 18 are bent upwardly to define a part of the interior 20, define an upper gap 23 between the outer edges 22 that is located opposite the base portion 16 across the longitudinal axis A. However, in another approach, the outer edges 22 can be relatively flat or straight, rather than rounded, and can still define the upper gap 23. In some situations, the sizing wings 18 may contact each other or overlap each other, such that the upper gap 23 is thereby not defined.

The spoon portion 17 extends proximally from the base portion 16 and slightly upward from the base portion 16 at an acute angle relative to the base portion. The spoon portion 17 has a rounded shape that defines an upwardly facing concave face 24 that faces toward the interior 20. The spoon portion 17 further defines a downwardly facing convex face 26 that faces away from the interior 20. The convex face 26 is preferably used for contacting the string of a musical instrument during playing, while the concave face 24 contacts or faces the end of a user's finger, thereby covering the end of the finger.

Figure 4:
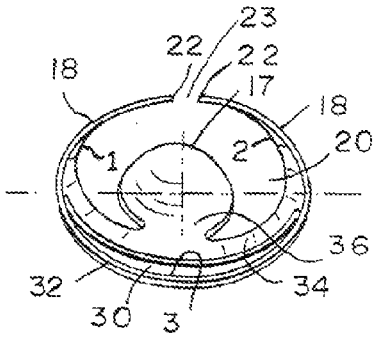
FIG. 4 is an end view of an embodiment of the finger pick.

The base portion 16 further defines an opening 30 extending through the base portion 16. The opening 30 has a generally elongate shape that is longer in a direction transverse to the longitudinal axis than it is wide in a direction along the longitudinal axis. Put another way, the opening 30 is defined to have an oval shape. The opening 30 is sized such that it extends into the sizing wings 18 of base portion 16. When the sizing wings 18 are in a bent configuration, the opening extends upwardly along with the sizing wings 18, such that the opening 30 extends around the longitudinal axis A, as shown in FIG. 4. Depending on the size of the user's finger and the shape of the sizing wings 18 to account for the size of the user's finger, the opening 30 can, in one approach, extend around the axis A 180 degrees or more. However, it will be appreciated that on a relatively larger finger, the opening may extend less than 180 degrees around the axis A while still extending around the axis A to some degree because of the opening 30 extending into the sizing wings 18 and the sizing wings 18 being curved around the axis A.

To define the opening 30 in the base portion 16, the base portion 16 includes a rear strip 32 and a front strip 34. The rear strip 32 is located distally from the opening 30 and the front strip 34. The front strip 34 is located proximally from the opening 30 and the rear strip 32, and distally from the spoon portion 17. The rear strip 32 and the front strip 34 each extend transverse to the longitudinal axis A and extend generally parallel to each other. In one approach, the rear strip 32 is thinner than the front strip 34 as measured in the direction of the longitudinal axis A.

The spoon portion 17 and the base portion 16 combine to define a neck portion 36 at the intersection between the spoon portion 17 and the base portion 16. Accordingly, the outer profile of the finger pick 10 defines a pair of recesses 38 on opposing sides of the neck portion 36. The recesses 38 can have a concave shape facing outwardly from the neck 36. The neck portion 34 therefore can have a smaller width measured transverse to the longitudinal axis than the width of the spoon portion 17. This reduced width allows for the neck 34 to act as a living hinge and allows the spoon portion 17 to be bent upwardly and downwardly to accommodate the size and shape of the user's finger, as desired.

The finger pick 10 is preferably made from brass or another metal or other material that is lightweight and malleable and deformable. The malleable deformation of the finger pick 10 allows for it to be adjusted to fit the size of the user's finger, and can accommodate a wide range of finger sizes. The sizing wings 18 do not need to clamp the finger in order to hold the finger pick 10 on the user's finger, so this allows for the finger pick 10 to be made thinner than prior finger picks that use clamping wings that require a larger amount of holding force to keep it in place. While the finger pick 10 has been described as being made of a malleable and deformable metal material, it will be appreciated that other materials could also be used. For example, a deformable plastic material could be used and be heated and cooled for sizing purposes In another approach, the finger pick 10 could be made from a semi-rigid and resilient material, such as an injection molded plastic. This particular approach may have a reduced ability to be modified and sized to different sized fingers, but will retain many of the other advantages described herein if appropriately sized to a user's finger.

In one approach, the finger pick 10 is in the form of a single unitary piece, such that the various above described portions transition into each other. The finger pick 10 accordingly can be made by stamping a pattern in a sheet of metal material based on a pre-defined profile, and subsequently bent and formed into the above described shape. However, in an alternative approach, the finger pick 10 could be made by joining together separate pieces, using adhesive, mechanical fasteners, welding, or other manners of joining separate pieces. For example, the base portion 16 could be joined to a separate spoon portion 17 to construct the overall finger pick 10.

Figure 3:
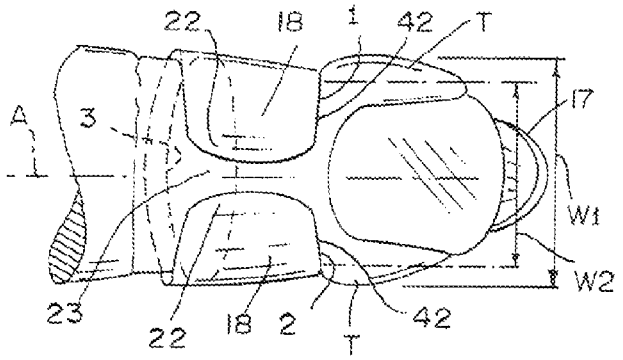
FIG. 3 is top view of an embodiment of the finger pick attached to the finger.

The base portion 16 and wing portions 18, when in the bent and formed configuration, have a general cone shaped profile when viewed from the top and sides, as seen in FIG. 3. Put another way, the outer profile of the finger pick 10 tapers in a proximal direction from the distal end. This cone shape enables the finger pick 10 to be inserted over the end of a user's finger to conform to the typical shape of a finger, which increases in size away from the terminal end.

Figure 2:
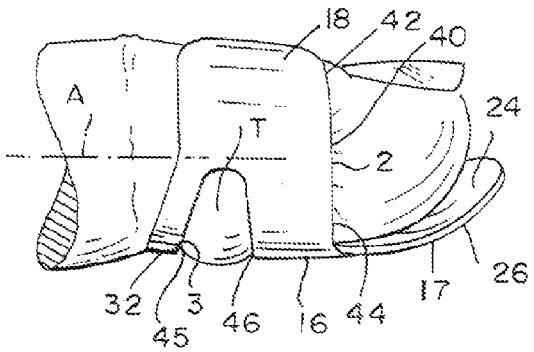
FIG. 2 is a side view of an embodiment of the finger pick, showing it attached to a user's finger in an installation position.

With reference to FIGS. 2 and 3, the sizing wings 18 define a front edge 40 that includes an upper shoulder portion 42 when the sizing wings 18 are bent upwardly from the base portion 16. The upper shoulder portions 42 are accordingly disposed on opposite sides of the longitudinal axis A from each other, as well as being on an opposite side of the longitudinal axis A relative to the opening 30 defined by the base. The front edge 40 also defines lower shoulder portions 44 that are below the upper shoulder portions 42. The lower shoulder portions 44 of the front edge 40 transition into the neck portion 34.

The shoulder portions 42, 44 and the opening 30 are arranged and configured to pass over a soft tissue portion of the finger near the base of the user's fingernail, providing multiple points of securement of the finger pick 10. The opening 30 includes a rear edge 45 and a front edge 46. The rear edge 45 is arranged and configured to pass over a soft tissue portion of the finger pad, providing an additional point of securement of the finger pick 10. These points of securement will be described in further detail below.

Having described the structure of the finger pick 10, the attachment to the user's finger and retention on the user's finger will now be described.

As described above, the finger pick 10 has a cone shape for the base portion 16. This cone shape allows the user's finger to be received in the finger pick 10 in a comfortable manner. When inserted on the finger, the finger pick 10 is pushed over the fingertip toward the first knuckle of the finger. The distal end 12 of the finger pick 10 will contact the sides of the user's finger around the fingernail. More specifically, the base portion 16 and the sizing wings 18 will contact the soft tissue T of the user's finger around the fingernail. The soft tissue T is, as described, soft, and will be compressed and otherwise moved in response to contact with the base portion 16 and sizing wings 18.

As the base portion 16 and sizing wings 18 are moved further downward on the user's finger toward the first knuckle, the base portion 16 and sizing wings 18 will move past the soft tissue T around the fingernail. Once the base portion 16 and sizing wings 18 have been pushed down on the finger past the fingernail, the soft tissue T around the fingernail will be released to protrude radially outward, as shown in FIG. 3. With the soft tissue T extending outwardly, the finger pick 10 is held in place at two points of contact on opposite sides of the longitudinal axis A creating resistance to removal. These first and second points of contact are labeled 1 and 2 on FIGS. 1-4. As can be seen in particular in FIG. 3, the soft tissue T is extending radially outward at points 1 and 2, which resists the ability of the finger pick 10 to be removed from the finger.

The above described points of contact 1 and 2 provide for a portion of the retention ability of the finger pick 10. However, the finger pick 10 is held on the finger by a third point of contact 3, further described below.

The soft tissue T on the sides of the finger around the fingernail provide for points of contact 1 and 2 for the finger pick. In addition to the soft tissue T around the fingernail, the soft tissue T on the pad of the finger and near the first knuckle also provides for retention of the finger pick 10.

Figure 5:
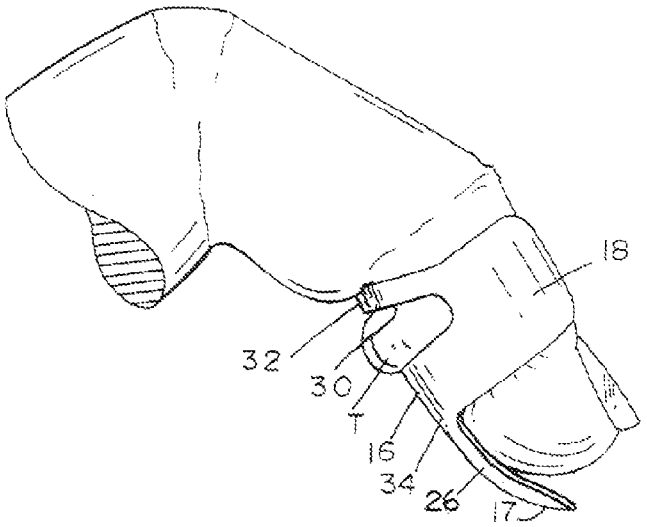
FIG. 5 is a side view of an embodiment of the finger pick attached to the finger, with the finger in a bent position.

As the finger pick 10 is disposed over the end of the finger and the fingernail 10, the base portion 16 will slide across the soft tissue T of the pad of the finger. More particularly, the rear strip 32 will compress against the soft tissue T on the pad of the finger. As the finger pick 10 is further disposed over the fingertip, the rear strip 32 will approach a crease at the bending point of the first knuckle of the user. When the rear band reaches the area of the finger near the crease, the soft tissue T of the finger pad will be allowed to extend radially downward through the opening 30 of the finger pick, as shown in FIGS. 2 and 5. The protrusion of the soft tissue T of the finger pad through the opening 30 creates the third point of contact 3, shown in FIGS. 1-4.

The third point of contact 3, in addition to the first and second points of contact 1 and 2, provides for a more robust and reliable manner of retention of the finger pick 10 relative to prior finger pick designs. By allowing the soft tissue T to protrude through the opening 30, in addition to at the sides of the finger near the base of the fingernail, the outward reactive force of the soft tissue T that is created when the soft tissue is compressed is used advantageously to retain the finger pick 10 on the finger. Without the opening 30, as is the case with prior designs, the compressed soft tissue would have nowhere to go, and would continue to push against the finger pick to force the finger pick off the end of the finger due to the tapered shape of a typical fingertip. Accordingly, the present design of the finger pick 10 uses the reactive forces of the soft tissue to its advantage to secure the finger pick 10 on the finger, rather than working against these forces as prior designs attempt to do by clamping.

Further, by the finger pick 10 defining the three points of contact 1, 2, and 3, the sizing wings 18 do not need to be used for clamping, as in prior designs. The sizing wings 18 do not need to provide an inward radial force on the finger, which can be painful, to create a frictional force to hold the finger pick 10. The sizing wings 18 instead can simply be adjusted to correspond to the size of the finger enough such that the soft tissue T around the base of the fingernail can protrude outward beyond the outer profile of the front edge 40. As shown in FIG. 3, when the finger pick 10 is installed on the finger, the soft tissue T has a width W1 that is greater than the width W2 of the front edge 40.

Upon installation of the finger pick 10 on the finger, the spoon portion 17 can be adjusted such that it extends around the end of the finger pad. This can be adjusted to suit the needs and desires of the user regarding the spacing of the spoon portion 17 from the pad of the finger.

With the finger pick 10 installed on the user's finger, the soft tissue T at the three points of contact 1, 2, and 3 acts as a detent, and the soft tissue T is relaxed and not under substantial compression. The soft tissue T resists removal of the finger pick 10 until such time as the soft tissue T is manipulated to release the finger pick 10. To release the finger pick 10, the soft tissue T can be pushed back into the opening 30, reducing or eliminating the third point of contact 3, and the finger pick 10 can therefore overcome the resistance to removal and be pulled off the finger.

With reference to FIG. 5, the finger pick 10 has increased retention ability during times when the finger is in a bent position, which is common during the playing of musical instruments, especially when playing a "picking" style. When the finger bends at the first knuckle, the soft tissue T on the finger pad tends to be forced outward near the crease in the finger. Instead of creating an outward force that would push a finger pick off the finger, the soft tissue T will protrude further out of the opening 30, increasing the retention ability at the third point of contact 3. Thus, instead of being harder to retain, the finger pick 10 receives increased retentive ability when the finger is bent during a time when retention of the finger pick 10 has increase importance, i.e. while playing the instrument. Simply put, when the finger is bent, such as during the playing of the instrument, the finger pick 10 having the opening 30 is more difficult to remove.

Accordingly, the resistance to removal is highest when the finger is bent during playing, as shown in FIG. 5, and the resistance to removal is lower when the finger is more straight, as shown in FIG. 2.

Figure 6:
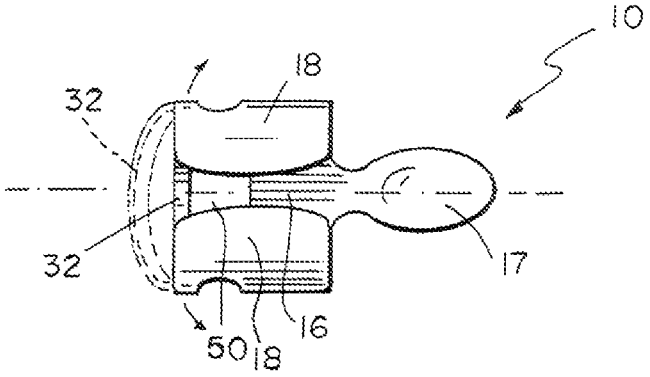
FIG. 6 is a top view of another embodiment of a finger pick.
Figure 7:
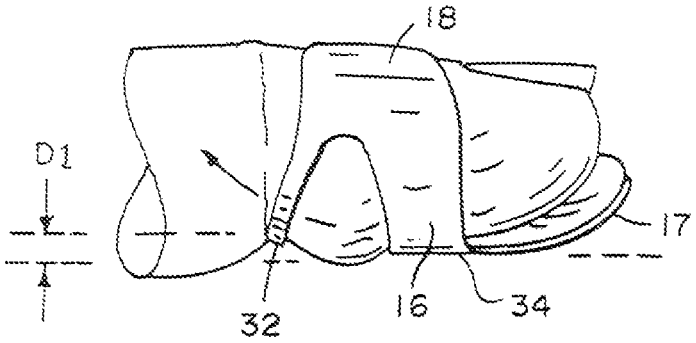
FIG. 7 is a side view of the finger pick of FIG. 6 attached to a user's finger.

With reference to FIGS. 6 and 7, in an alternative approach, the finger pick 10 can define an opening 50 that has a width in the longitudinal direction that, in one approach, is smaller than the previously described opening 30. In one embodiment, the laterally extending edges of the opening 50 are generally straight, in contrast to the ovular shape of the opening 30. In this approach, the rear strip 32 is thinner than in the previously described embodiment.

With reference to FIG. 6, the finger pick 10 is shown in a top view with the sizing wings 18 bent arcuately from the base portion 16. The rear strip 32 is bendable rearwardly away from the spoon portion 17, as shown in dotted lines on FIG. 6. The rear strip 32 is therefore bendable rearward, which in turn increases the size of the opening 50, such that the size of the opening 50 more closely resembles the previously described opening 30.

In addition, due to the rearward bending, and with reference to FIG. 7, the rear strip 32 is also bendable upward toward the crease in the first knuckle of the user's finger to increase the space of the opening 50 and allow additional soft tissue T to protrude out of the opening 50 to retain the finger pick 10. Accordingly, in this approach, the rear strip is disposed above the remainder of the base portion 16 and the spoon portion a distance D1. The upward displacement of the rear strip 32 in this bendable approach can result in increased retention ability, with the rear strip 32 more securely received in the fold of the user's knuckle. The retention of the finger pick 10 on the finger is accomplished in manner similar to that described above, with the three points of contact.

Furthermore, with the rear strip bent upward and rearward into the crease of the user's finger, the sizing wings 18 can be deformed outward, which in turns forces the rear strip 32 further upward and rearward, moving the rear strip 32 further into the fold, providing for a tighter fit on the user's finger.

Figure 8:
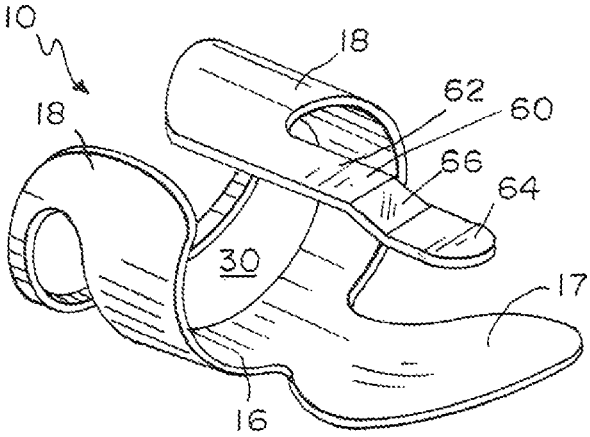
FIG. 8 is an isometric view of another embodiment of a finger pick having a stabilizing member.
Figure 9:
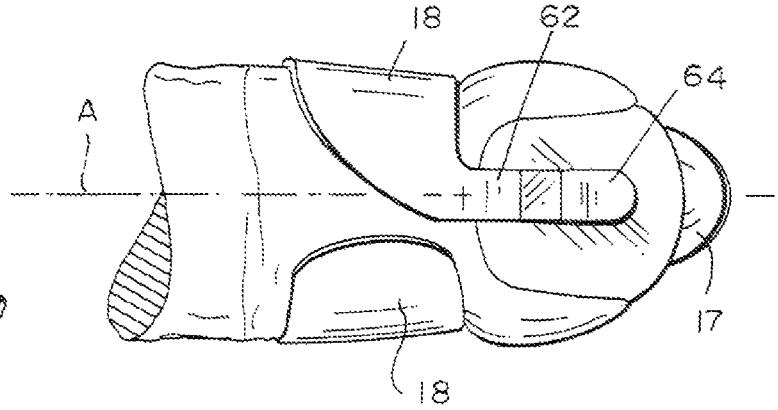
FIG. 9 is a top view of the finger pick of FIG. 8 attached to user's finger.
Figure 10:
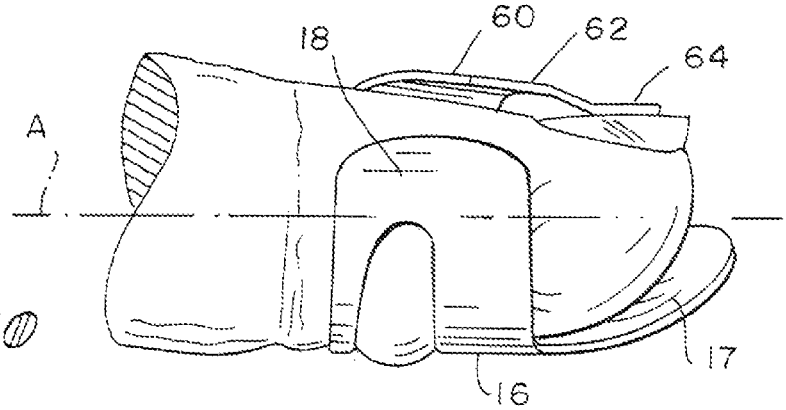
FIG. 10 is a side view of the finger pick of FIG. 8 attached to the finger.

With reference to FIGS. 8-10, in another aspect, the finger pick 10 includes a stabilizer 60 that is preferably integrally formed as part of the finger pick 10.

The stabilizer 60 is disposed on the top of the finger pick 10. Put another way, the stabilizer is disposed on the opposite side of the longitudinal axis A from the base portion 16 when the sizing wings 18 are bent upward to define the interior 20 of the interior pick 10, as described above.

The stabilizer 60 extends in a longitudinal direction. More specifically, it extends in a proximal direction from the end of one of the sizing wings 18. The stabilizer 60 is preferably disposed above the longitudinal axis A and is generally parallel to the longitudinal axis A, such that it is disposed along the center of the finger pick 10.

The stabilizer has a base portion 62 and an end portion 64. The base portion 62 is connected to the end of the one of the sizing wings 18 and extends longitudinally away from the sizing wings 18. The end portion 64 is connected to the base portion 62 and extends longitudinally away from the base portion 62. The end portion 64 is connected to the base portion 62 via an intermediate portion 66.

The end portion 64 is preferably disposed closer to the longitudinal axis than the base portion 62. Accordingly, the intermediate portion 66 slopes downward toward the longitudinal axis A from the base portion 62 toward the end portion 64. In another approach, the end portion 64 and base 62 lie in approximately the same plane and, as such, there is no defined intermediate portion.

In one approach, the end portion 64 and base portion 62 have approximately the same width as measured transverse to the longitudinal axis A. In another approach, the end portion 64 can have a smaller width or a greater width. In one approach, the end portion 64 and base portion 62 have a tapered width. It will be appreciated that other sizing configurations between the end portion and the base portion can also be used. For example, the end portion 64 could be in the form of an enlarged head having a circular or ovular shape.

In a preferred approach, the end portion 64 is shorter than the base portion 62 when measured along the longitudinal axis. However, the end portion 64 and base portion 62 could have equivalent lengths, or the end portion 64 could be longer than the base portion 62.

The stabilizer 60 is preferably malleable, similar to the malleable nature of the remainder of the finger pick 10. The malleable nature of the stabilizer allows it to be sized to fit the particular size of the user's finger. However, in another approach, the stabilizer could be a separate component that is attached to the finger pick 10 via known attachment methods. In this approach, the stabilizer 60 could be more malleable or less malleable than the remainder of the finger pick 10.

As shown in FIGS. 9 and 10, when the finger pick 10 is installed on the user's finger, as previously described above with the three points of contact and the soft tissue retaining the finger pick 10, the stabilizer 60 will lie above the finger on the opposite side of the finger from the base portion 16 and the spoon portion 17. The end portion 64 of the stabilizer 60 will preferably contact the upper surface of the user's fingernail. The stabilizer 60 can be bent or deformed toward the user's fingernail to provide for the desired sizing and comfort of the user.

If the finger pick 10 is pulled radially away from the user's finger, the stabilizer 60 will likewise be pulled in the same direction. However, due to the positioning of the stabilizer above the fingernail, the fingernail will exert a reaction force upward on the stabilizer 60. The opposite reaction force will counteract the radially force on the finger pick 10, limiting the finger pick 10 from being pulled radially away from the finger. Accordingly, the stabilizer provides a fourth point of contact to retain the finger pick 10 on the user's finger, with the retention being in the radial direction.

This fourth point of contact is primarily beneficial to limiting movement of the finger pick 10 caused by the recoil effect inherent in playing a stringed instrument. When a string is actuated by the user using the finger pick 10, the finger pick 10, and in particular the spoon portion 17, will vibrate back and forth after plucking a string. The stabilizer 60 can counteract that recoil effect, keeping the finger pick 10 substantially in place in response to the recoil.

While the above description constitutes the preferred embodiment of the present disclosure, it will be appreciated that the disclosure is susceptible to modification, variation and change without departing from the proper scope and fair meaning of the accompanying claims.

The invention claimed is:

1. A pick for being retained on a user's digit, the pick comprising:

a base portion defining a longitudinal length;

a pair of sizing wings extending laterally outward from opposite sides of the base portion and being substantially arcuate to extend from the base portion in a curved manner;

wherein the base portion and the sizing wings define an interior space and a longitudinal axis extending from a distal end to a proximal end;

a spoon portion extending proximally from the base portion; and an opening defined by the base portion and the sizing wings that extends laterally across the base portion and into the sizing wings.

2. The pick of claim 1, wherein the sizing wings are deformable to allow the sizing wings to be adjustable to the size of the user's digit.

3. The pick of claim 1, wherein the sizing wings each define a front edge and the front edges each define a point of contact against which soft tissue of the user's digit will contact when the pick is installed on a user's digit.

4. The pick of claim 1, wherein the opening defines a point of contact against which soft tissue of the user's digit will contact when the pick is installed on the digit.

5. The pick of claim 1, wherein the base portion includes a rear strip disposed distally of the opening and a front strip disposed proximally of the opening, wherein the rear strip is configured to engage adjacent the crease in a knuckle of a user's digit.

6. The pick of claim 5, wherein the rear strip is deformable distally away from the front strip and also radially inward toward the longitudinal axis.

7. The pick of claim 5, wherein the rear strip deforms in response to bending the sizing wings.

8. The pick of claim 1, wherein the sizing wings include end portions that define a space therebetween when the sizing wings are arcuately formed.

9. The pick of claim 1, wherein the sizing wings include end portions that overlap when the sizing wings are arcuately formed.

10. The pick of claim 1, wherein the spoon portion is deformable relative to the base portion.

11. The pick of claim 1, wherein the opening extends around the longitudinal axis when the sizing wings are bent upward.

12. The pick of claim 5, wherein a thickness of the rear strip is less than a thickness of the front strip in the longitudinal direction.

13. The pick of claim 1, wherein the base portion, sizing wings, and spoon portion are a unitary structure.

14. The pick of claim 1, wherein the sizing wings each define an first shoulder portion one a first side of the longitudinal axis and the opening defines a rear edge portion on a second side of the longitudinal axis that is opposite the first side, and the first shoulder portion and the rear edge portion combine to create three points of contact for retaining the pick on the digit against soft tissue that extends outward from the pick at each of the points of contact.

15. The pick of claim 1, wherein the opening is configured to allow soft tissue of the digit to protrude therethrough in response to bending of the user's digit.

16. The pick of claim 1, further comprising a stabilizer extending from an end of one of the sizing wings, wherein the stabilizer is disposed on an opposite side of the longitudinal axis from the spoon portion and the base portion when the sizing wings are bent upward.

17. A pick for being retained on a user's digit, the pick comprising:

a base portion;

a spoon portion extending in a proximal direction from the base portion;

a pair of wings being arcuately formed and extending outwardly from the base portion and being disposed distally from the spoon portion; and a stabilizer portion extending proximally from an end of at least one of the wings;

wherein the base portion, spoon portion, and wings combine to define an interior space having a longitudinal axis, and the stabilizer is disposed on the opposite side of the longitudinal axis from the base portion and the spoon portion.

18. The pick of claim 17, wherein the base portion and the wings define an opening through both the base portion and each of the wings, wherein the opening extends laterally around the longitudinal axis.

19. The pick of claim 17, wherein the stabilizer is integral with the end of the at least one of the wings from which the stabilizer extends.

20. A pick for being retained on a user's digit, the pick comprising:

a base portion having proximal and distal ends;

a pair of sizing wings extending outwardly from the base portion and curving away from the base portion, the sizing wings each having a proximally facing front edge; and an opening defined by the base portion and sizing wings, the opening extending through the base portion and sizing wings and defining a proximally facing rear edge;

wherein the proximally facing front edges of the sizing wings and the proximally facing rear edge of the opening combine to define three points of contact for contacting soft tissue of a user's digit when the pick is inserted over the end of the user's digit.

* * * * *